United States Patent [19]

Kaczerginski et al.

[11] 4,435,615

[45] Mar. 6, 1984

[54] SEALED END CAP MOUNTING FOR LAMINATED INSULATOR CORE

[75] Inventors: Alexandre Kaczerginski, Bellerive sur Allier; Michel Willem, Vichy, both of France

[73] Assignee: Societe Anonyme dite: CERAVER, Paris, France

[21] Appl. No.: 343,343

[22] Filed: Jan. 27, 1982

[30] Foreign Application Priority Data

Feb. 5, 1981 [FR] France ..... 81 02205

[51] Int. Cl.[3] ..... H01B 17/02; H01B 17/38

[52] U.S. Cl. ..... 174/189; 174/179; 174/186

[58] Field of Search ..... 174/140 S, 176, 177, 174/178, 179, 186, 188, 189

[56] References Cited

U.S. PATENT DOCUMENTS

| | | | |
|---|---|---|---|
| 3,534,989 | 10/1970 | Yonkers | 174/176 X |
| 3,585,277 | 6/1971 | Lewis | 174/178 X |
| 4,316,054 | 2/1982 | Willem | 174/179 X |

*Primary Examiner*—Laramie E. Askin

*Attorney, Agent, or Firm*—Kenyon & Kenyon

[57] ABSTRACT

An insulator core including a rod (20) fitted with a sheath (12) and with insulating fins (2,3) is fixed in a metal cap (10,10') by embedding the end (1) of the rod (20) in an organic embedding substance (9) in a thimble (5,5'), which has undercut zones and a flange (7) which is bonded or crimped to the sheath in a sealed manner, and embedding the thimble (5,5') in the cap (10,10') using a cheap inorganic cement (11). The thimble is coated with an anti-adhesive layer (27) which does not adhere to the embedding cement.

8 Claims, 2 Drawing Figures

SEALED END CAP MOUNTING FOR LAMINATED INSULATOR CORE

BACKGROUND OF THE INVENTION

The present invention relates to an insulator having a laminated core, and particularly to means for mounting a fixing cap onto the core.

Such an insulator comprises both an elongate core including at least one rod made of agglomerated fibers and fixing caps, each of which has a recess in which one of the end core is fixed by an embedding substance. Between the caps, the rod is protected by a covering such as a sheath of insulating substance and may optionally be provided with fins.

An insulator of this type is designed to transmit high mechanical forces and with this aim in view, published French patent specification No. 2,345,796 and No. 2,360,968 in particular describe the use of a recess of a particularly advantageous shape; said recess is shaped like two truncated cones or, more precisely, is flared on either side of an intermediate zone. Thus, when the insulator is subjected to a high traction force, the core with its associated embedding substance tends to slip in the recess of the cap, giving rise to radial compression forces on the rod which cause it to be trapped in the cap.

However, to obtain this result, it is essential for the cap recess to be the right shape and for its surface to be free from rough parts, and therefore careful machining and finishing are usually necessary.

The present invention aims to mitigate this drawback and to allow end caps to be used whose shape and surface condition are not subject to special requirements and which can be obtained, e.g., by casting and used practically in the rough condition in which they leave the foundry.

SUMMARY OF THE INVENTION

The present invention provides an insulator comprising a pair of fixing caps and an elongate core made of organic material and which includes a rod made of agglomerated fibres, one of said caps being fitted at each end of the core, with the rod being covered in between the caps by a protective covering of insulating material. Each cap has a core-receiving recess supplied with embedding substance. Each end of the rod is sealed inside a thimble by means of an organic substance, said thimble being received in the core-receiving recess in the corresponding one of the fixing caps, said thimble having a rim that is sealed to said covering of insulating material and a side wall of corrugated profile which is coated on the outside with an anti-adhesive layer that does not adhere to the embedding substance in the core-receiving cap recess.

A line made up of alternate concave and convex curves is herein referred to as a corrugated profile.

The preferred corrugated profile is formed in such a way that the thimble is shaped substantially like a double truncated cone.

In accordance with a particularly advantageous embodiment, the thimble is embedded in said recess by means of a cement mortar which can be, e.g., a very cheap aluminous mortar.

The recess of the cap may also have a corrugated inside surface with a frusto-conical shape or a shape like a double truncated cone, for example.

The rims of the thimbles can be glued to or crimped on the protective covering, which is generally made of an elastomer.

BRIEF DESCRIPTION OF THE DRAWINGS

Embodiments of the invention are described by way of example with reference to the accompanying drawings in which.

DETAILED DESCRIPTION

Figure 1:
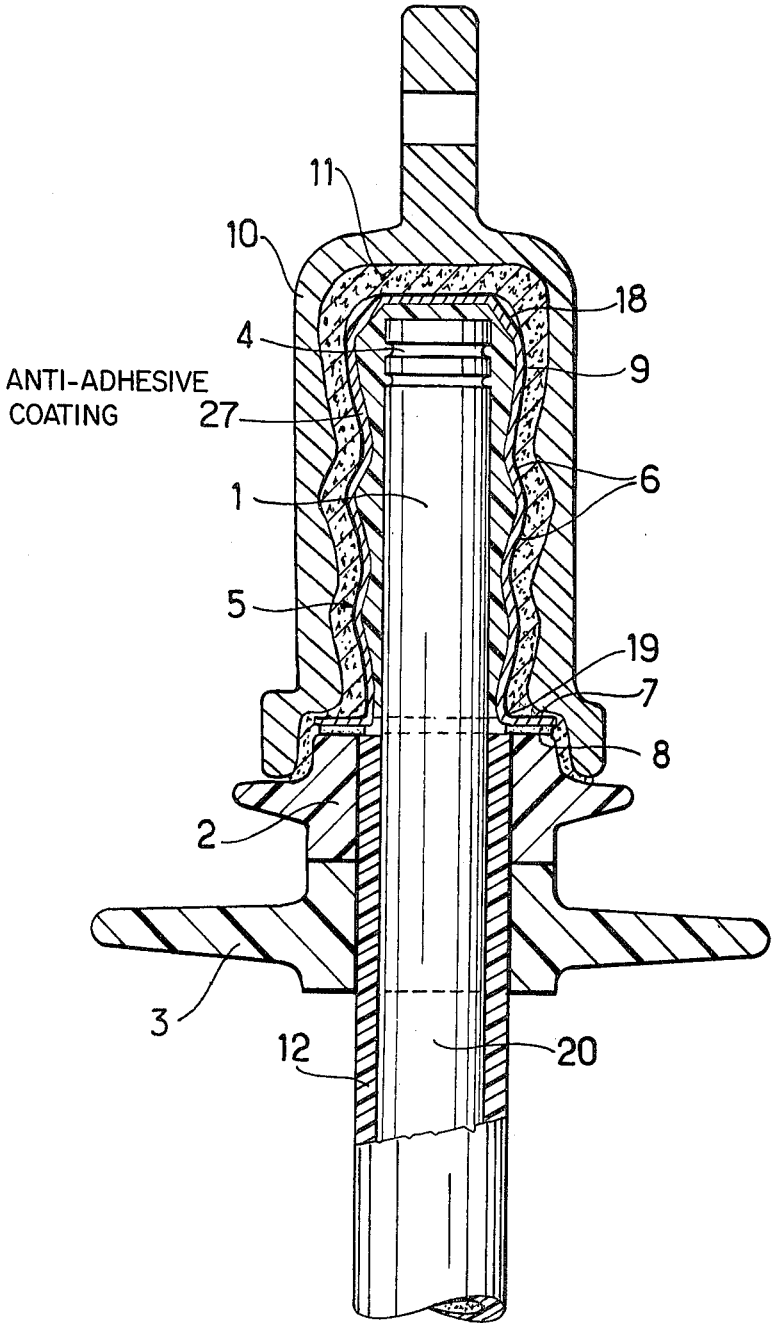
FIG. 1 is a diagrammatic cross-section through an insulator in accordance with the invention.

The core of the insulator illustrated in FIG. 1 has a central rod 20 made of agglomerated glass fibres which is protected by an elastomer sheath 12 made, e.g., of EPDM and which is provided with fins, only two of which, 2 and 3, are shown in the figure. The end 1 of the rod 20 is machined so as to have grooves 4 whose bottoms may be polygonal, if it is required to prevent said rod from rotating.

As seen hereinafter, the end of the rod 1 is embedded in a fibre-filled organic substance 9 enclosed in a thin metal thimble 5 which has undercut zones 6 so that it has the shape of a double truncated zone. The thimble 5 has reinforcing members 18 at its end to prevent rotation its outer wall is covered with a coating of a substance 27 which does not adhere to cementitious layer 11 for embedding the thimble in an end cap 10; said substance is, for example, a varnish or any other non-adherent covering applied in a thin layer by fluidization.

The rim of the thimble 5 forms a flange 7 which is previously treated to allow it to adhere to the fin 2.

A thimble 5 of this shape is cheap and easy to mass-produce. The cap, in which it is designed to be embedded by means of the substance 11, is a cast iron cap 10 which is galvanized both on the inside and on the outside. Like the wall of the thimble, its inside wall has the general shape of a double truncated cone.

The end of the rod 1 is joined to the cap 10 as follows:

A predetermined quantity of organic embedding substance 9 is disposed inside the thimble 5 which is placed with its flange turned upwards; a layer of glue 8 is applied to the flange 7 of the thimble; and the end 1 of the sheathed rod is then pushed into the thimble until the fin 2 contacts the layer of glue 8. The assembly thus formed is preferably disposed in a vacuum chamber, and the thimble may be heated.

The quantity of organic embedding substance is predetermined so that the final level does not reach the flange 7. To be able to accommodate an unforeseen excess of embedding substance, in one variant (not illustrated), it may be envisaged to use a thimble in which the neck 19 is more flarged than the one illustrated.

When the embedding substance 9 has hardened and the flange 7 adheres strongly to the fin 2, a core of an insulator in accordance with the invention has been produced. It forms a sealed assembly in which the rod-to-sheath and the sheath-to-fin interfaces are perfectly insulated. Said core assembly can therefore be stored conveniently during a long period before its end caps are fitted to it, as previously described.

The embedding substance 11 used in these end caps is a known cement mortar.

When a mechanical traction force is applied to the insulator, the insulator core moves inside the end cops, due to the fact that the thimble 5 is covered with an anti-adhesive substance 27 between said thimble and the embedding substance 11. The thimble is trapped in the embedding substance 11, however, because of its corrugated profile. The core assembly formed by the thimble, the rod, the covering substance 12, and the fins 2, 3 moves relative to the cap 10, but the flange-to-fin connection is not affected.

The surface condition on the inside and outside of the cap 10 is not important, since slippage is between the thimble 5 and the embedding substance 11, and not between the embedding substance 11 and the cap 10.

Figure 2:
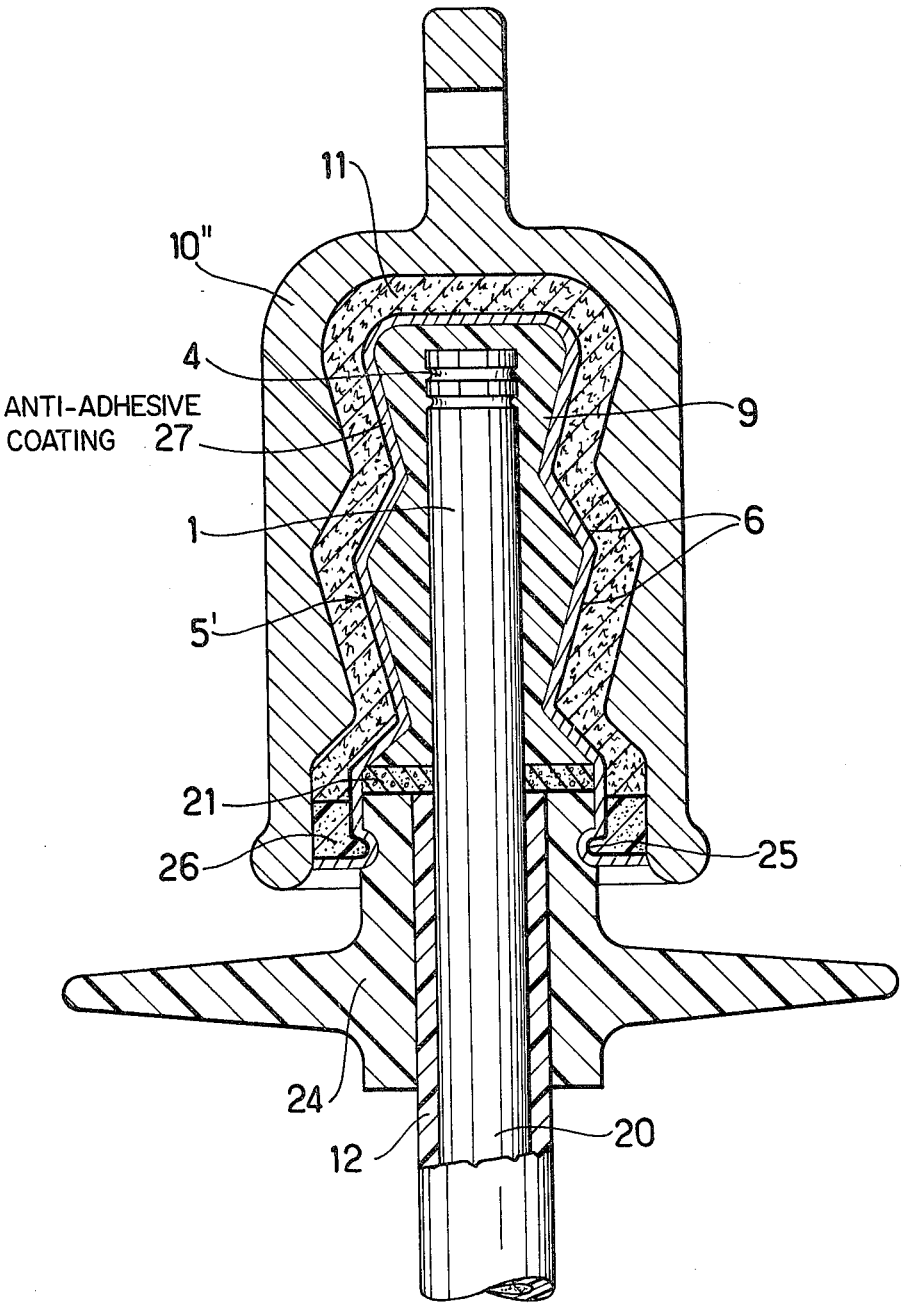
FIG. 2 is a diagrammatic cross-section through a variant of the insulator shown in FIG. 1.

Of course, the invention is not limited to the embodiment which has just been described. Thus, FIG. 2 illustrates a variant in which the inner edge 25 of a flange of a thimble 5' is crimped in a sealed manner to an elastomer covering 24. A washer 21 made of an expanded substance is interposed between the organic embedding substance 9 and the covering substance 24. The function of filler insulating substance 26 between the thimble 5' and a cap 10' is to prevent dust from gathering; this is more important for the opposite end of the insulator to that illustrated in FIG. 2 (i.e., the lower end if the insulator is installed vertically).

Likewise, the double frusto-conical shapes described are only advantageous forms. Any shape of corrugated profile can be used which is suitable for fixing the core in the end cap by applying pressure to the embedding substances.

We claim:

1. An insulator having an elongated core including a fiber reinforced rod of organic material, a mass of hardened organic substance formed on one end of the rod, a thimble encasing the mass of organic substance, the thimble having a side wall of corrugated profile in longitudinal cross section and a rim, and a protective insulating sheath covering the rod and sealed to the rim of the thimble, and a fixing cap having an internal surface defining a core-receiving recess, an embedding substance fixed to the internal surface of the cap defining the core-receiving recess, the thimble being slidably embedded in said embedding substance, wherein the improvement comprises:

the mass of hardened organic substance directly contacts the inner surface of the corrugated side wall of the thimble to form a rigid connection therewith, and the outer surface of the corrugated side wall of the thimble is coated with an anti-adhesive layer that does not adhere to the embedding substance, so that the thimble, the mass of hardened organic substance, and the one end of the rod form a rigid assembly completely sealed to the insulating sheath and resistant to large tensile forces applied between the fixing cap and the other end of the core.

2. An insulator according to claim 1, wherein said corrugated profile is such that said side wall of said thimble has substantially the shape of a double truncated cone.

3. An insulator according to claim 1, wherein said embedding substance is mortar cement.

4. An insulator according to claim 1, wherein said internal surface of the cap defining said core-receiving recess has a corrugated profile.

5. An insulator according to claim 4, wherein said corrugated profile of said internal surface of the cap is generally shaped like a double truncated cone.

6. An insulator according to claim 1, wherein said anti-adhesive layer is a varnish.

7. An insulator according to claim 1, wherein the rim of said thimble is glued to said protective insulating sheath.

8. An insulator according to claim 1, wherein the rim of said thimble is crimped to said protective insulating sheath.

* * * * *